US009226082B2

(12) United States Patent
Friis et al.

(10) Patent No.: US 9,226,082 B2
(45) Date of Patent: Dec. 29, 2015

(54) HEARING AID WITH MEANS FOR ESTIMATING THE EAR PLUG FITTING

(71) Applicant: Widex A/S, Lynge (DK)

(72) Inventors: Lars Friis, Varlose (DK); Soren Christensen, Copenhagen (DK); Ole Hau, Stenlose (DK); Per Kokholm Sorensen, Virum (DK); Morten Agerbaek Nordahn, Bronshoj (DK)

(73) Assignee: Widex A/S, Lynge (DK)

( * ) Notice: Subject to any disclaimer, the term of this patent is extended or adjusted under 35 U.S.C. 154(b) by 266 days.

(21) Appl. No.: 13/953,242

(22) Filed: Jul. 29, 2013

(65) Prior Publication Data

US 2014/0037099 A1 Feb. 6, 2014

Related U.S. Application Data

(63) Continuation-in-part of application No. PCT/EP2011/052022, filed on Feb. 11, 2011.

(51) Int. Cl.
*H04R 25/00* (2006.01)

(52) U.S. Cl.
CPC ..... *H04R 25/30* (2013.01); *H04R 25/305* (2013.01); *H04R 25/70* (2013.01); *H04R 2460/15* (2013.01)

(58) Field of Classification Search
CPC ..... H04R 25/30; H04R 25/70; H04R 25/305; H04R 2460/15
See application file for complete search history.

(56) References Cited

U.S. PATENT DOCUMENTS

| | | | | |
|---|---|---|---|---|
| 6,687,377 | B2 * | 2/2004 | Voix et al. | 381/60 |
| 7,406,179 | B2 * | 7/2008 | Ryan | 381/312 |
| 2007/0019817 | A1 | 1/2007 | Siltmann | |
| 2008/0123882 | A1 | 5/2008 | Bauml et al. | |
| 2008/0175401 | A1 | 7/2008 | Frohlich | |
| 2008/0260171 | A1 * | 10/2008 | Nordahn et al. | 381/60 |
| 2009/0122996 | A1 * | 5/2009 | Klein et al. | 381/56 |
| 2009/0274314 | A1 | 11/2009 | Arndt et al. | |

FOREIGN PATENT DOCUMENTS

| | | | |
|---|---|---|---|
| EP | 1465454 | A2 | 10/2004 |
| WO | 2010/049543 | A2 | 5/2010 |
| WO | 2010/083888 | A1 | 7/2010 |

OTHER PUBLICATIONS

International Search Report for PCT/EP2011/052022 dated Dec. 6, 2011.

* cited by examiner

*Primary Examiner* — Brenda Bernardi
(74) *Attorney, Agent, or Firm* — Sughrue Mion, PLLC

(57) ABSTRACT

A hearing aid (1) comprising a receiver (2) and at least one first microphone for transforming an acoustic signal surrounding a hearing aid user into an electrical signal, where the hearing aid comprises an ear plug part prepared for fitting tightly into the car canal (11) of a hearing aid user such that an inner volume is formed in the inner part of the ear canal between the car plug part and the car drum of the hearing aid user. The car plug part comprises a second microphone (3) arranged for transforming an acoustic signal in the volume into an electrical signal. The hearing aid comprises estimating means for estimating the effective size of the air leak between the inner volume and the surroundings based on the acoustical signal detected in said volume by said second microphone (3) from a known acoustical signal below 1000 Hz generated by the receiver. The hearing aid further comprises notification means for notifying the hearing aid user if the size range of the air leak is outside a predefined range.

14 Claims, 4 Drawing Sheets

HEARING AID WITH MEANS FOR ESTIMATING THE EAR PLUG FITTING

RELATED APPLICATIONS

The present application is a continuation-in-part of application No. PCT/EP2011/052022, filed on Feb. 11, 2011, in Europe and published as WO-A1-2012107100.

BACKGROUND OF THE INVENTION

1. Field of the Invention

The present invention relates to hearing aids. The invention more particularly relates to a hearing aid comprising a receiver and at least one first microphone for transforming an acoustic signal surrounding a hearing aid user into an electrical signal. The invention further relates to a method for estimating an air leak in an ear plug.

The invention is especially pertinent for a hearing aid comprising an ear plug part prepared for fitting tightly into the ear canal of a hearing aid user. The ear plug part comprises a second microphone arranged for transforming an acoustic signal in said volume into an electrical signal.

In the context of the present disclosure, a hearing aid should be understood as a small, microelectronic device designed to be worn behind or in an ear of a hearing-impaired user. The hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer.

A Behind-The-Ear (BTE) hearing aid is worn behind the ear, and has a housing comprising the major electronics parts behind the ear and an earpiece, called ear plug in the following, for emitting sound to the hearing aid user. The ear plug is worn in the ear, e.g. in the concha or in the ear canal. In a traditional BTE hearing aid, a sound tube is used for conducting sound from a loudspeaker or receiver in the housing to the ear plug. In some types of hearing aids the receiver is arranged in the ear plug and is connected through electrical conductors to the housing behind the ear. Such hearing aids are commonly referred to as Receiver-In-The-Ear (RITE) hearing aids. In a specific type of RITE hearing aids the receiver is placed inside the ear canal. This is known as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This type is known as Completely-In-Canal (CIC) hearing aids. This type of hearing aid requires a very compact design in order to allow it to be arranged in the ear canal, while accommodating the components necessary for operation of the hearing aid, such as microphones, a microelectronic circuit comprising a signal processor, an acoustic output transducer and a battery.

Hearing aids or ear plugs of hearing aids are made to fit tightly in the ear canal of the hearing aid user in order to achieve an optimum sound amplification without risk of feedback. The inner volume is the volume into which the receiver transmits sound in the inner part of the ear canal delimited by the ear plug or hearing aid.

Any need for air ventilation into the inner ear canal is taken care of by a well controlled ventilation channel, often referred to as a vent. The ventilation channel (or vent) is an intentional air leak between the volume in front of the ear drum limited by the ear plug or hearing aid, and the surroundings outside the ear canal. A ventilation channel has the advantage of reducing any occlusion effect (see explanation in WO-A1-2010/083888 page 1-3). The ventilation channel usually has a tubular shape, and the diameter is selected as a compromise between the wish to reduce occlusion and the need to obtain a sufficiently high sound pressure level at the ear drum.

For new hearing aid users it may be difficult to place the hearing aid or the hearing aid ear plug correctly in the ear canal and to verify that it is correctly placed. In the following, the term ear plug is used to refer to the part in the ear canal, whether it is an ear plug of a behind-the-ear hearing aid, an in-the-ear hearing aid or a completely-in-canal hearing aid. It may be difficult for new hearing aid users to detect if the hearing aid ear plug has changed position and is no longer correctly placed. If the hearing aid is not correctly placed in the ear canal an unintended air leak between the space in front of the ear drum and the surroundings may be formed. Such an air leak will increase the risk of feedback and it will reduce the sound pressure level at the ear drum. The benefits of the hearing aid will therefore be reduced.

This accidentally formed air leak is a non-intentional air leak. The sum of the intentional air leak and the non-intentional air leak is referred to as the effective air leak.

2. The Prior Art

US 2007/0019817 disclose a hearing aid which by playing an acoustic test signal can measure if the fitting of the hearing aid is correct. The test signal measured by a microphone is compared to a reference determined beforehand and stored in the hearing aid. If the test signal detected by the microphone deviates from the reference, information is given to an external unit that the fitting is not correct.

WO 2010/049543 discloses a method of measuring feedback of a hearing aid and, based on a comparison with feedback measured when the hearing aid is optimally fitted into the ear canal, deciding if the hearing aid is properly inserted in the ear canal of the hearing aid user.

US 2008/0123882 discloses a hearing aid which is automatically switched off when removed from the ear canal. The removal of the hearing aid is detected by generating an acoustic signal and detecting changes to the signal captured from this generated signal.

The problem of these known means for controlling the fitting of a hearing aid in the ear canal, or the removal of the hearing aid, is that they can only be applied for telling if the fitting is correct or not. Any more detailed information, such as if the fitting is far from being correct or if it is almost correct, cannot be obtained by these methods.

SUMMARY OF THE INVENTION

The invention, in a first aspect, provides a hearing aid comprising a receiver and at least one first microphone for transforming an acoustic signal surrounding a hearing aid user into an electrical signal, said hearing aid comprising an ear plug part adapted for fitting tightly in the ear canal of a hearing aid user such that an inner volume is formed in the inner part of the ear canal between the ear plug part and the ear drum of the hearing aid user, said ear plug part comprising a second microphone adapted for transforming an acoustic signal in said volume into an electrical signal, estimating means for estimating the effective size of the air leak between said inner volume and the surroundings based on the acoustical signal detected in said volume by said second microphone from a predetermined acoustical signal at a frequency below 1000 Hz, generated by said receiver, and notification means for notifying the hearing aid user if the size of said air leak is outside a predefined range.

A hearing aid ear plug is here considered as the part of the hearing aid arranged in the ear canal, i.e. it could be the ear plug of a behind-the-ear hearing aid or the whole of a completely-in-canal hearing aid. Estimating means could be an algorithm implemented on an integrated circuit in the hearing aid. Notification means could be sounding an alarm or a voice message through the receiver. If the hearing aid user applies two hearing aids with some kind of wireless communication, a notification could also be given by the other hearing aid.

The advantage of the solution is that it will provide a measure on the size of the effective air leak, i.e. the sum of the ventilation channel (the intentional air leak) and the air leak caused by a hearing aid having moved partly out of position in the ear canal (the non-intentional air leak).

This more detailed information, i.e. a more exact measure, opens for some further opportunities. One is to allow for compensation in the hearing aid amplification, i.e. increasing the amplification to compensate the reduction in sound pressure at the ear drum caused by the larger air leak. Another opportunity is to inform the hearing aid user how close the hearing aid is to the optimal placement.

In an embodiment the hearing aid also comprises test signal means for providing a specific test signal with a predetermined sound pressure level and frequency distribution through the receiver. Compared to relying on sounds from the background noise a specific well defined test signal will provide a more accurate result, and it will also be possible to estimate the air leak.

In an embodiment the estimating means of the hearing aid applies the sound pressure level at a specific frequency for estimating the size of the open air leak. This makes the measurement less sensitive to background noise and more accurate.

In a further embodiment the estimating means of the hearing aid applies identifying at least one frequency having a peak value in sound pressure level for estimating the effective size of the air leak. This may provide an even more accurate measurement.

In an embodiment the acoustical signal generated by the receiver of the hearing aid has a frequency below 200 Hz, preferably below 150 Hz. As described below, this will facilitate estimating the effective air leak without having performed a calibration beforehand with the ear plug correctly placed.

In an embodiment the notification means is adapted for providing information about changes in the effective size of the air leak, to provide feedback to the hearing aid user regarding the fit of the ear plug part. The feedback will guide the user to optimize the placement of the hearing aid plug.

In a further embodiment the hearing aid comprises control means adapted for estimating the effective size of the air leak between said inner volume and the surroundings based on the acoustical signal detected in said volume by said second microphone from a predetermined acoustical signal at a frequency below 1000 Hz, generated by said receiver, upon having provided user feedback, so as to verify whether the fitting of the hearing aid plug was improved. This enables the hearing aid to provide follow-up information, e.g. concerning an improved fitting or a lack of improvement.

In a further embodiment the hearing aid comprises compensation means for adjusting the transfer function of the hearing aid in order to compensate for the reduced sound pressure level due to an incorrect fit of the ear plug in the ear canal. This may be a solution if the hearing aid user does not adjust the fitting of the ear plug. In this way the hearing aid user may still benefit from the hearing aid, even though the placement of the ear plug in the ear canal is no longer correct.

In a further embodiment the estimating means of the hearing aid is adapted for including the effect of directly transmitted sounds in the estimate of the effective air leak. Directly transmitted sound is here understood as sounds from the surroundings of the hearing aid, which reach the ear drum without having been amplified. Directly transmitted sound passes through the ventilation channel, and other air leaks around the ear plug part, and into the inner volume in the ear canal. Such directly transmitted sound may influence the estimation of the effective size of the air leak. This influence depends on the sound pressure level of the surrounding sounds and on the effective air leak during the time where the acoustical signal, applied for estimating the effective air leak, is generated.

In a further embodiment the estimating means of the hearing aid is adapted for finding the size range of the directly transmitted sound from simultaneous measurements of the sound pressure level by the first microphone and by the second microphone. The first microphone measures the sound pressure level in the surroundings of the hearing aid user, and the second microphone measures the sound pressure level in the inner part of the ear canal, i.e. in the volume formed between the ear plug part and the ear drum. The ratio between these two sound pressure levels, at the first and second microphone, can be applied for estimating the directly transmitted sound. Preferably, the directly transmitted sound should be estimated in the same frequency range where the receiver generates the acoustical signal applied for estimating the effective size of the air leak. Also, it will be advantageous to estimate the directly transmitted sound just before or after (e.g. within a second or less) generating the acoustical signal applied for estimating the effective size of the air leak. This will reduce the risk of changes in the effective size of the air leak between the estimation of the directly transmitted sound and the estimation of the effective size of the air leak.

In a further embodiment the acoustic signal applied for estimating the effective size of the air leak is the output of the hearing aid when it operates in its normal sound amplifying mode. In normal mode, the sound from the surroundings is captured by the first microphone, amplified and output by the hearing aid receiver. Relying on this output requires some sound (e.g. speech) to be present in the surroundings. Provided that the amplification is sufficiently high this acoustic signal is so strong that it can be used for estimating the effective size of the air leak without the estimate being substantially biased by directly transmitted sound. Typically the amplification varies over time. The amount of amplification applied can be monitored and the estimation only performed while the amplification is sufficiently high and there is also sufficient sound in the surroundings to amplify. This has the advantage that the estimation can take place during normal use of the hearing aid without interrupting the function of the hearing aid as a sound amplifying device.

In a second aspect, the invention provides a method for estimating the effective size of the air leak of a hearing aid ear plug arranged in the ear canal of a hearing aid user, said method comprising arranging an ear plug part in the ear canal of a hearing aid user such that an inner volume is formed in the inner part of the ear canal between the ear plug part and the ear drum of the hearing aid user, generating a predefined acoustical signal at a frequency below 1000 Hz by a receiver of said hearing aid, transforming said acoustic signal in said inner volume into an electrical signal by a microphone arranged in said ear plug part and facing said inner volume, estimating the effective size of the air leak between said inner, volume and the surroundings based on the acoustical signal detected in said inner volume by said microphone, and notifying the hearing aid user if the effective size of said air leak is outside a predefined range.

In an embodiment the method comprises selecting the frequency range and sound pressure level of the test signal according to the specific hearing loss of the hearing aid user. This will permit selecting a test signal at a frequency and a level where the user has less hearing acuity, in order to minimize bother to the hearing aid user. This is especially a possibility which is of interest if the hearing loss is at lower frequencies.

In an embodiment of the method the test signal is applied both for detecting effective air leak and as signal sound providing information about the placement of the hearing aid to the hearing aid user. Thereby the same sound from the receiver may be applied for two different purposes. In a further embodiment the test signal is provided as pulses, and the frequency or the length of the pulses is modulated for indicating when the placement of the hearing aid is correct. This is an efficient way for the hearing aid user to hear if the placement of the earplug is improved or not.

The method according to the invention may also be used to detect if the effective air leak becomes smaller than the intentional air leak. This would happen if the ventilation channel is fully or partly blocked, e.g. by cerumen, and the ear plug is placed correctly in the ear canal. This situation could also be notified to the hearing aid user in order to alert him or her to clean the ventilation channel

BRIEF DESCRIPTION OF THE DRAWINGS

Embodiments of the invention will now be explained in further detail with reference to the figures.

DETAILED DESCRIPTION OF THE INVENTION

Figure 1:
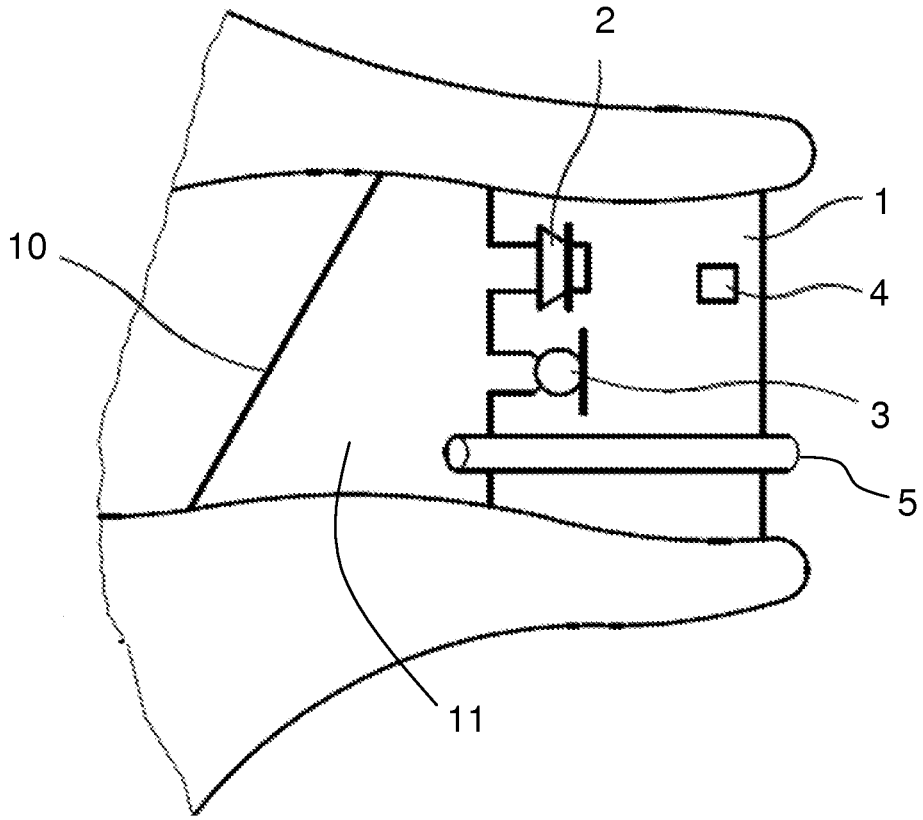
FIG. 1 illustrates an in-the-canal hearing aid.

FIG. 1 shows a completely-in-the-canal hearing aid 1 arranged in the ear canal 11 of a hearing aid user. The hearing aid 1 comprises a receiver 2 for generating an acoustic output in front of the ear drum 10, and an opening 4 for a first microphone arranged in order to detect acoustic signals from outside the ear of the hearing aid user, i.e. from the surroundings. The hearing aid 1 further comprises a ventilation channel 5, i.e. an intentional air leak, e.g. serving the purpose of reducing occlusion. The hearing aid 1 further comprises a second, or internal, microphone 3, for detecting sound in the internal volume formed between the ear drum and the hearing aid.

The hearing aid of FIG. 1 could also be an in-the-ear hearing aid which is partly in the canal and partly in the concha. Further, it could be a behind-the-ear hearing aid with an earplug, comprising at least the second or internal microphone 3.

The ventilation channel 5 is an option often favored due to its advantages, e.g. in relation to occlusion. However, if a high gain is necessary due to a profound hearing loss, a ventilation channel may be avoided since a higher sound pressure at the eardrum can be obtained without the ventilation channel.

The ventilation channel 5 may have different forms. It may be arranged along the surface of the hearing aid or hearing aid plug.

Figure 2:
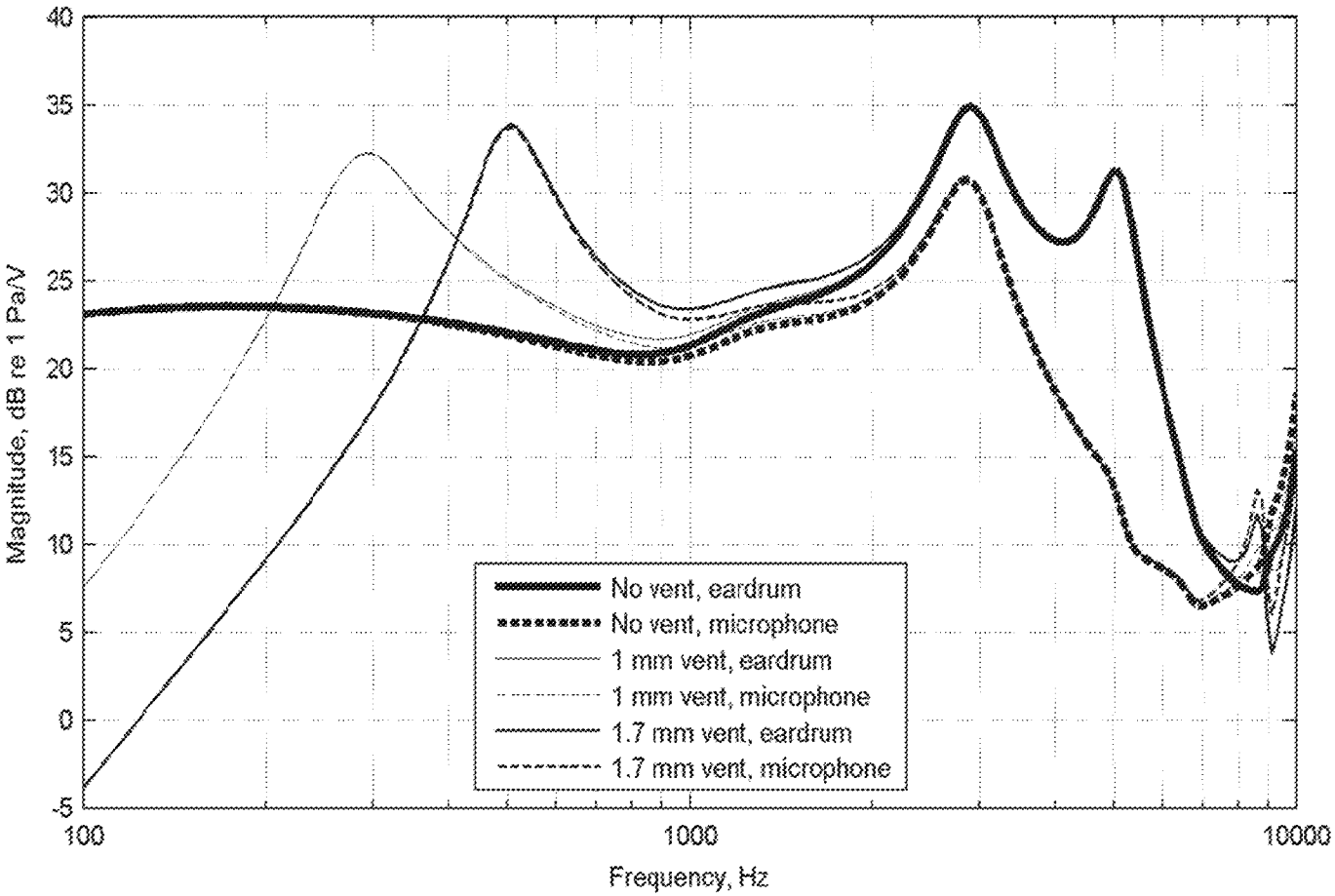
FIG. 2 illustrates the sound pressure level at an internal microphone and at the ear drum as function of frequency for different ventilation channel sizes.

FIG. 2 shows simulations of the sound pressure relative to the applied voltage to the receiver of a Widex Passion hearing aid (available from Widex A/S, Lynge, Denmark) with an instant fit ear plug in an IEC 711 coupler. Such a coupler may be considered as a model ear to be applied as a reference ear. An internal microphone has been assumed to be arranged in the ear plug. The simulations have been made for three different sizes of ventilation channel. One without ventilation, one with a ventilation channel diameter of 1.0 mm, and one with a ventilation channel diameter of 1.7 mm, both channels having a length of 10 mm. For each ventilation channel size two curves are shown; one giving the sound pressure at the ear drum as function of frequency and one giving the sound pressure at the internal microphone as function of frequency.

It can be seen from FIG. 2 that below 800 Hz and approximately also below 1000 Hz there is no difference or only a small difference between the sound pressure at the internal microphone position and at the ear drum. There is on the other hand significant difference between the sound pressure levels for different ventilation channel sizes. To the contrary, above approximately 2500 Hz there is a significant difference between the sound pressure level at the internal microphone position and the level at the ear drum, while the ventilation channel size does not influence the sound pressure level.

Based on the curves illustrated in FIG. 2 it is seen that for frequencies below 800 Hz it is possible to play a well defined sound by the hearing aid receiver and, by recording the sound pressure level picked up by the internal microphone, to establish an estimate of the effective air leak. When information on the actual ventilation channel size is stored in the hearing aid, it will be possible to calculate if the effective air leak is larger than the intentional air leak. This calculation could be performed in the signal processor of the hearing aid.

The estimate of the effective air leak found by application of curves like those in FIG. 2 is based on a well known volume seen from the internal microphone, or at least that the sound recorded by the microphone due to a predetermined acoustic signal being played by the receiver has been well characterized. In practice this will often mean that the earplug must be arranged in the optimal position by the hearing aid fitter, whereupon the internal microphone records the acoustic signal played by the receiver. Results of this calibration should be stored in the hearing aid, and used for comparison when the effective air leak is estimated.

Figure 3:
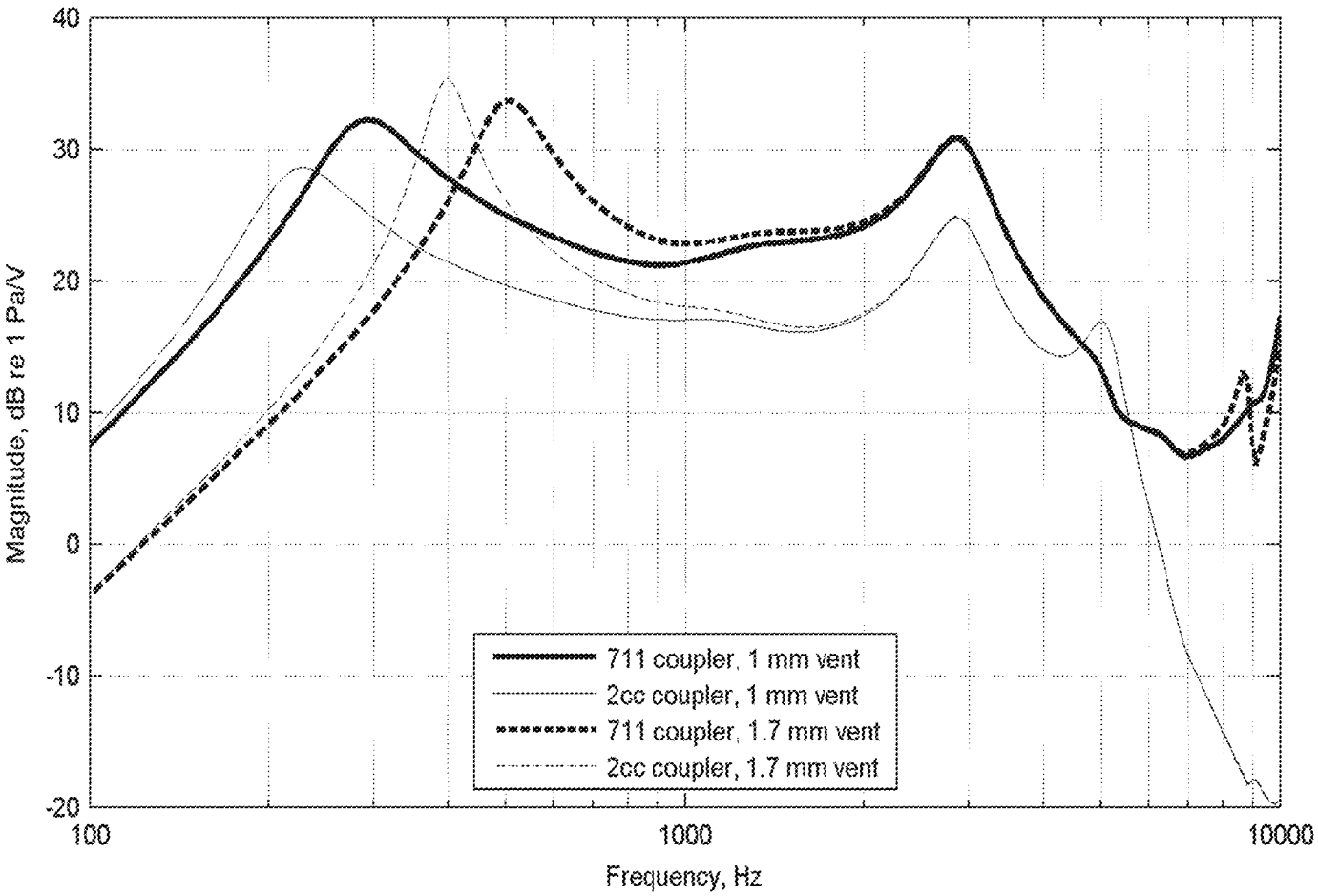
FIG. 3 illustrates the sound pressure level at an internal microphone as function of frequency for two different internal volume sizes and for two different ventilation channel sizes.

FIG. 3 shows simulations of the sound pressure by a Widex Passion hearing aid with an instant fit ear plug provided with an internal microphone. The simulations have been made for two different sizes of ventilation channel, one with a ventilation channel diameter of 1.0 mm, and one with a ventilation channel diameter of 1.7 mm, and both having a length of 10 mm. For each ventilation channel size the sound pressure at the internal microphone as function of frequency is given for two different couplers representing two different ear canals. The two couplers are the IEC 711 coupler and the 2 cc coupler (e.g. according to the standard ANSI S 3.22). The 711 coupler is considered to have a volume close to the volume seen from the ear plug or the hearing aid for an average person, whereas the volume of the 2 cc coupler is larger.

It can be seen from FIG. 3 that below approximately 150 Hz there is no difference in the obtained sound pressure levels between the two different couplers, i.e. there is no effect of the volume seen from the internal microphone on the sound pressure level. At the same time there is a clear effect of the ventilation channel size. For frequencies above approximately 1500 Hz the situation is the opposite: No effect of the ventilation channel size, but a clear effect of the volume is seen.

From the curves of FIG. 3 it is seen that it will be possible to estimate the effective air leak by application of an acoustical signal of e.g. 200 Hz or lower, without any knowledge of the volume behind the ear plug or hearing aid. This means that when an acoustical signal below 200 Hz, preferably below 150 Hz, is applied no calibration with regard to the volume is needed. Only the geometry of the ventilation channel, e.g. diameter and length, must be known.

If for example the receiver is fed with a 100 Hz and 1 Volt signal it can be seen from the curves in FIG. 3 that the sound pressure at the internal microphone will be −4 dB re 1 Pa when the ventilation channel is 1.7 mm in diameter. The same signal will result in a sound pressure at the internal microphone of 8 dB re 1 Pa if the diameter of the ventilation channel is 1 mm. These values are obtained for a correctly placed ear plug. If the ear plug is not correctly placed and the effective air leak is larger than the ventilation channel, then these values will be lower by an amount correlated to the size range of the effective air leak.

If the ear plug is not provided with any ventilation channel the sound pressure at the internal microphone should be independent of the frequency in the frequency range below 200 Hz.

It may be possible to dispense with a specific well defined acoustic signal provided by the receiver and rely instead on background sounds. The electrical power provided to the receiver within a specific frequency range can be compared with the sound pressure level recorded by the microphone. Based on a known transfer function of the receiver and the curves of FIG. 2 or 3 the effective air leak can be estimated. However, relying on background sounds may make the estimation more sensible to directly transmitted sounds.

A well defined signal provided by the receiver may also be applied for guidance of the hearing aid user during insertion of the ear plug. This could be by providing a well defined sound in a broad frequency spectrum during a limited period when the ear plug is inserted into the ear canal. Such a sound would become familiar to the hearing aid user who would learn to position the ear plug in the ear canal by relying on changes in the sound.

Figure 4:
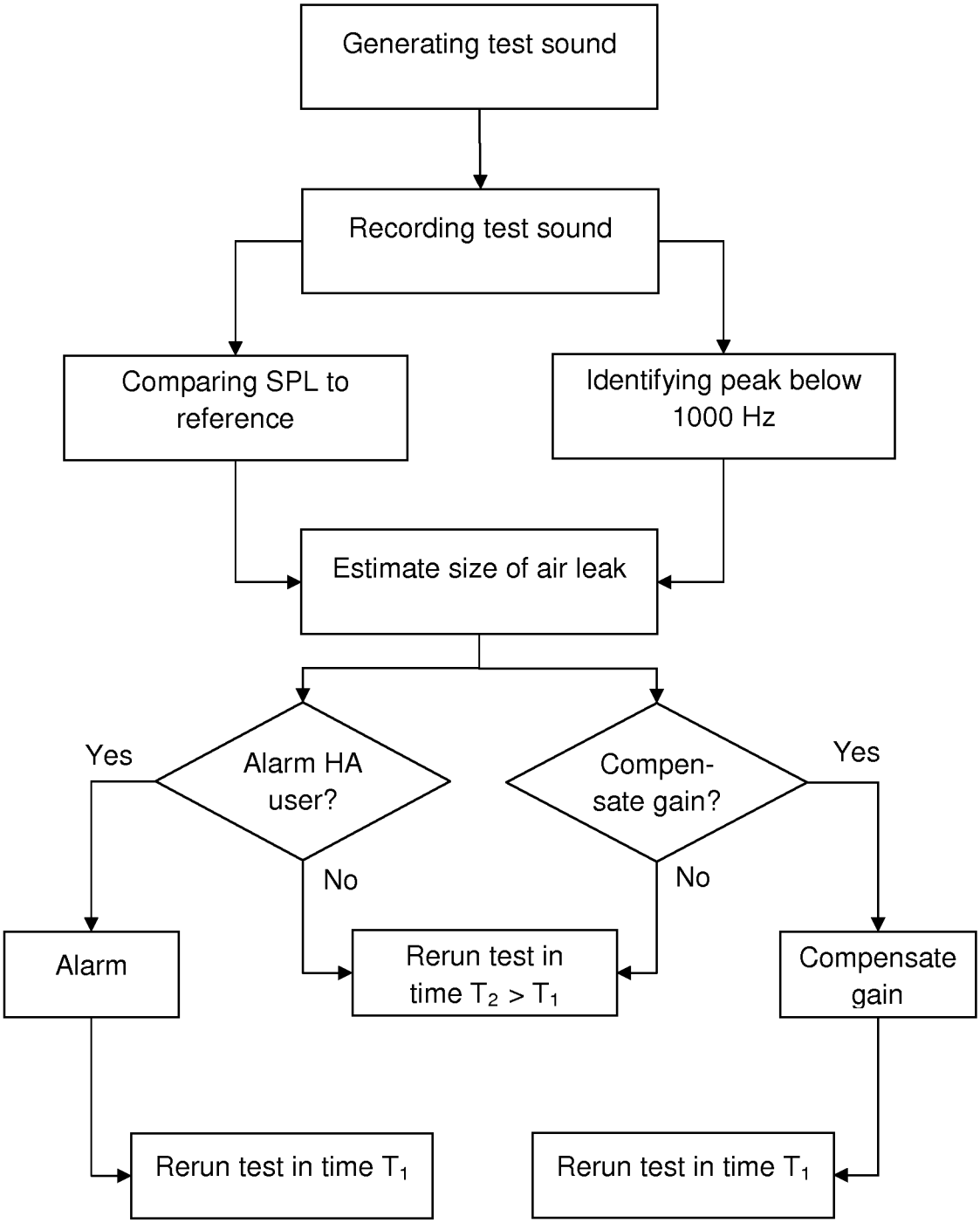
FIG. 4 illustrates a block diagram of a method for estimating the placement of a hearing aid in the ear canal.

FIG. 4 shows a block diagram of an embodiment of a method according to the invention. The first step is to generate a test sound by the receiver in the volume in the ear formed behind the ear plug. The test sound should have a sufficiently low frequency, i.e. below 1000 Hz or even below 200 Hz or below 150 Hz, if no calibration of the earplug with receiver and internal microphone in the ear canal of the user has been performed. The generated test sound may be within a given frequency range. Preferably the test sound is chosen to disturb the hearing aid user as little as possible.

The next step in FIG. 4 is to record the test sound by the internal microphone, digitizing the signal and processing it in a signal processing unit, e.g. the hearing aid signal processor. Two different methods may be applied in order to estimate the size of the air leak. One method is to compare the sound pressure level to a reference value obtained through a calibration, or, if a test signal frequency below e.g. 150 Hz is applied, simply measuring the sound pressure level. The second method can be applied when the test signal comprises a continuous frequency range. Then peak values can be identified and compared to a reference. Both methods can also be applied simultaneously in order to obtain a more accurate result.

When the effective air leak has been estimated it can be decided if there is any non-intentional air leak. If there is a non-intentional air leak, and maybe if it is above a predefined minimum value, then it has to be decided whether an alarm should be given to the hearing aid user. Furthermore, it may also be considered to adjust the gain in order to compensate for the reduced sound pressure level at the ear drum caused by the non-intentional air leak. The system could also be set up such that compensation of the gain is only performed once at least one alarm has been given to the hearing aid user, and it has been found that no changes in placement of the ear plug have been performed.

Both the decision to provide an alarm or voice message to the hearing aid user and any decision to make a compensation of the gain may be made dependent on the size of the non-intentional air leak.

As indicated in FIG. 4 the procedure of generating a test sound may be performed again a given time $T_1$ after an alarm to the hearing aid user has been given, or after the gain has been compensated. The time $T_1$ should leave the hearing aid user sufficient time to adjust the fitting of the hearing aid. If the non-intentional air leak has been below a preset size no alarm has been given and no gain compensation has been made, the test could just be rerun after a time $T_2$, where $T_2$ is longer than $T_1$.

Any estimation of the direct transmitted sound should be performed before or after generating the test sound, such that the result of this could be applied in the estimation of the effective size of the air leak.

It should be possible to switch off the means for detecting correct fitting of the ear plug. This will often be relevant when the hearing aid user has learned to arrange the ear plug correctly. It should also be possible to switch off the alarm function (notifying means) or the function for compensating the gain when the effective air leak is too large.

Measurement of the effective air leak, and thereby testing if the ear plug is correctly fitted, may be initiated under different circumstances. It could be repeated at pre-selected time intervals, or the time intervals could be adjusted automatically depending on the ear plug fitting during the most recent tests. Measurement may also be initiated by the hearing aid user. It could also be applied during or just after insertion of the ear plug into the ear canal, e.g. the test could run once the hearing aid has started up or a short time interval, e.g. 10-20 seconds, later. Often an insufficient fitting of the ear plug will be set to trigger a voice message or some kind of alarm. The results of the measurements or test may also be stored in a log, either in the hearing aid or in an auxiliary unit through wireless transmission.

We claim:

1. A hearing aid comprising a receiver and at least one first microphone for transforming an acoustical signal surrounding a hearing aid user into an electrical signal, said hearing aid comprising an ear plug part adapted for fitting tightly in the ear canal of a hearing aid user such that an inner volume is formed in the inner part of the ear canal between the ear plug part and the ear drum of the hearing aid user, said ear plug part comprising a second microphone adapted for transforming an acoustical signal in said volume into an electrical signal, an estimator for estimating the effective size of the air leak between said inner volume and the surroundings based on the acoustical signal detected in said volume by said second microphone from a predetermined acoustical signal at a frequency below 1000 Hz, generated by said receiver, and a notifier for notifying the hearing aid user if the size of said air leak is outside a predefined range.

2. The hearing aid according to claim 1, comprising a test signal source for providing a specific test signal with a predetermined sound pressure level and frequency distribution through said receiver.

3. The hearing aid according to claim 1, wherein said estimator is adapted for relying on the sound pressure level at a specific frequency for estimating the size of the air leak.

4. The hearing aid according to claim 1, wherein said estimator is adapted for identifying at least one frequency having a peak value in sound pressure level for estimating the effective size of the air leak.

5. The hearing aid according to claim 1, wherein said acoustical signal generated by said receiver is at a frequency below 150 Hz.

6. The hearing aid according to claim 1, wherein said notifier is adapted for providing information about changes in the effective size of the air leak, to provide feedback to the hearing aid user regarding the fit of the ear plug part.

7. The hearing aid according to claim 6, comprising a controller adapted for estimating the effective size of the air leak between said inner volume and the surroundings based on the acoustical signal detected in said volume by said second microphone from the predetermined acoustical signal at a frequency below 1000 Hz, generated by said receiver, upon having provided user feedback, so as to verify whether the fitting of the ear plug part has improved.

8. The hearing aid according to claim 1, comprising a compensator for adjusting the transfer function of the hearing aid in order to compensate for the reduced sound pressure level due to an incorrect fit of the ear plug part in the ear canal.

9. The hearing aid according to claim 1, wherein said estimator is adapted for including the effect of directly transmitted sounds in the estimate of the effective air leak.

10. The hearing aid according to claim 9, wherein the estimator is adapted for finding the size range of the directly transmitted sound from simultaneous measurements of the sound pressure level by said first microphone and by said second microphone.

11. A method for estimating the effective size of the air leak of a hearing aid ear plug arranged in the ear canal of a hearing aid user, said method comprising arranging an ear plug part in the ear canal of a hearing aid user such that an inner volume is formed in the inner part of the ear canal between the ear plug part and the ear drum of the hearing aid user, generating a predetermined acoustical signal at a frequency below 1000 Hz by a receiver of said hearing aid, transforming said acoustical signal in said inner volume into an electrical signal by a microphone arranged in said ear plug part and facing said inner volume, estimating the effective size of the air leak between said inner volume and the surroundings based on the acoustical signal detected in said inner volume by said microphone, and notifying the hearing aid user if the effective size of said air leak is outside a predefined range.

12. The method according to claim 11, comprising selecting the frequency range and sound pressure level of the test signal according to the specific hearing loss of the hearing aid user, in order for the hearing aid user to be minimally bothered by the test signal.

13. The method according to claim 11, comprising applying the test signal both for detecting effective air leak and as a signal sound providing information about the placement of the hearing aid.

14. The method according to claim 13, wherein said test signal is provided as pulses, and wherein the frequency or the length of the pulses is modulated for indicating when the placement of the hearing aid is correct.

* * * * *